US007853035B2

(12) United States Patent
Tsunoda et al.

(10) Patent No.: US 7,853,035 B2
(45) Date of Patent: Dec. 14, 2010

(54) HEADPHONES AND HEADPHONES PLACEMENT DEVICE

(75) Inventors: Naotaka Tsunoda, Tokyo (JP); Keitaro Fujiwara, Tokyo (JP)

(73) Assignee: Sony Corporation, Tokyo (JP)

( * ) Notice: Subject to any disclaimer, the term of this patent is extended or adjusted under 35 U.S.C. 154(b) by 1146 days.

(21) Appl. No.: 11/509,726

(22) Filed: Aug. 25, 2006

(65) Prior Publication Data

US 2007/0053539 A1 Mar. 8, 2007

(30) Foreign Application Priority Data

Sep. 5, 2005 (JP) ..... 2005-256984

(51) Int. Cl.
*H04R 25/00* (2006.01)

(52) U.S. Cl. ..... 381/377; 381/374

(58) Field of Classification Search ..... 381/374–379, 381/381, 383; 455/575.2; 379/430
See application file for complete search history.

(56) References Cited

U.S. PATENT DOCUMENTS 1,546,567 A * 7/1925 Childress ..... 381/377
3,356,797 A * 12/1967 Konzelmann et al. ..... 379/430
3,447,160 A * 6/1969 Teder ..... 2/209
4,302,635 A * 11/1981 Jacobsen et al. ..... 381/371

FOREIGN PATENT DOCUMENTS

JP 7-306954 11/1995

* cited by examiner

*Primary Examiner*—Tuan D Nguyen
(74) *Attorney, Agent, or Firm*—Oblon, Spivak, McClelland, Maier & Neustadt, L.L.P.

(57) ABSTRACT

Disclosed herein is a pair of headphones that includes a head band having a pair of support arms and a pair of housings angularly movably mounted on the support arms, respectively, by pivots in confronting relation to each other. Each of the housings has a presser disposed therein near the pivot and projecting substantially perpendicularly to an outer surface of the housing, the presser having a head held against one of the support arms under resiliency, the head having a step engageable with the support arm for limiting angular movement of the housing with respect to the support arm.

2 Claims, 12 Drawing Sheets

HEADPHONES AND HEADPHONES PLACEMENT DEVICE

CROSS REFERENCES TO RELATED APPLICATIONS

The present invention contains subject matter related to Japanese Patent Application JP 2005-256984 filed in the Japanese Patent Office on Sep. 5, 2005, the entire contents of which being incorporated herein by reference.

BACKGROUND OF THE INVENTION

1. Field of the Invention

The present invention relates to a pair of headphones for use as wireless headphones incorporating a secondary cell, and a headphones placement device for use as a charger device for placing the housing of a pair of headphones for use as wireless headphones incorporating a secondary cell on a placement base such as a dedicated charger base and charging the secondary cell.

2. Description of the Related Art

Heretofore, there is known a wireless headphones system for placing a pair of wireless headphones incorporating a secondary cell on a dedicated charger base, as disclosed in Japanese Patent No. 2770389. The disclosed wireless headphones system has a charging connector disposed centrally on the head band of headphones doubling as a receiver, and charging terminals disposed on a dedicated charger base doubling as a transmitter. When the central portion of the head band of the headphones is placed on an upper surface of the charger base, the charging connector and the charging terminals are connected to charge the secondary cell incorporated in the wireless headphones.

Japanese Patent Laid-Open No. 2004-112858 discloses a charging device having a charging connector disposed on the housing of headphones doubling as a receiver, and a charging member disposed on the receiving surface of a receiving plate of a dedicated charger base doubling as a transmitter. When the housing of the headphones is placed on the receiving surface, the charging connector and the charging member are connected to charge a secondary cell incorporated in the headphones.

SUMMARY OF THE INVENTION

The above wireless headphones incorporating the secondary cell should desirably be placed easily in a given position on the dedicated charger base. It is also desirable that a plurality of contacts on the charging connector be connected reliably and stably to the charging terminals on the charger base.

Generally, if headphone housings which face respective support arms of the headband of headphones are angularly movable in the directions in which the housings face the support arms, then since the headphone housings are swingable with respect to the support arms, it is relatively difficult to position the housings on respective positioning members on a placement base such as a charger base or the like.

It is desirable to allow the housings of wireless headphones incorporating a secondary cell to be easily placed in given positions on a placement base such as a dedicated charger base.

According to the present invention, there is provided a pair of headphones including a head band having a pair of support arms; and a pair of housings angularly movably mounted on the support arms, respectively, by pivots in confronting relation to each other. In the pair of headphones, each of the housings may have a presser disposed therein near the pivot and projecting substantially perpendicularly to an outer surface of the housing. The presser may have a head held against one of the support arms under resiliency. The head may have a step engageable with the support arm for limiting angular movement of the housing with respect to the support arm.

According to the present invention, there is also provided a headphones placement device for placing a pair of headphones having a head band having a pair of support arms and a pair of housings angularly movably mounted on the support arms, respectively, by pivots in confronting relation to each other. The headphones placement device may include a placement base for placing the headphones thereon, the placement base having a pair of positioning cavities defined therein for receiving the housings, respectively, therein. Each of the positioning cavities may have a guide rib disposed therein for guiding one of the housings into the positioning cavity. Each of the housings may have a guide groove for receiving the guide rib therein and a presser disposed therein near the pivot and projecting substantially perpendicularly to an outer surface of the housing. The presser may have a head held against one of the support arms under resiliency. The head may have a step engageable with the support arm. When the step is engaged by the support arm, each of the housings may be placed in one of the positioning cavities.

With the above arrangement, when the step is engaged by the support arm, angular movement of the housing with respect to the support arm is limited. Therefore, the housings of wireless headphones incorporating a secondary cell, for example, can easily be placed in given positions on the placement base such as a dedicated charger base.

DETAILED DESCRIPTION OF THE PREFERRED EMBODIMENTS

Headphones and headphones placement devices according to embodiments of the present invention will be described below with reference to the drawings.

Figure 1:
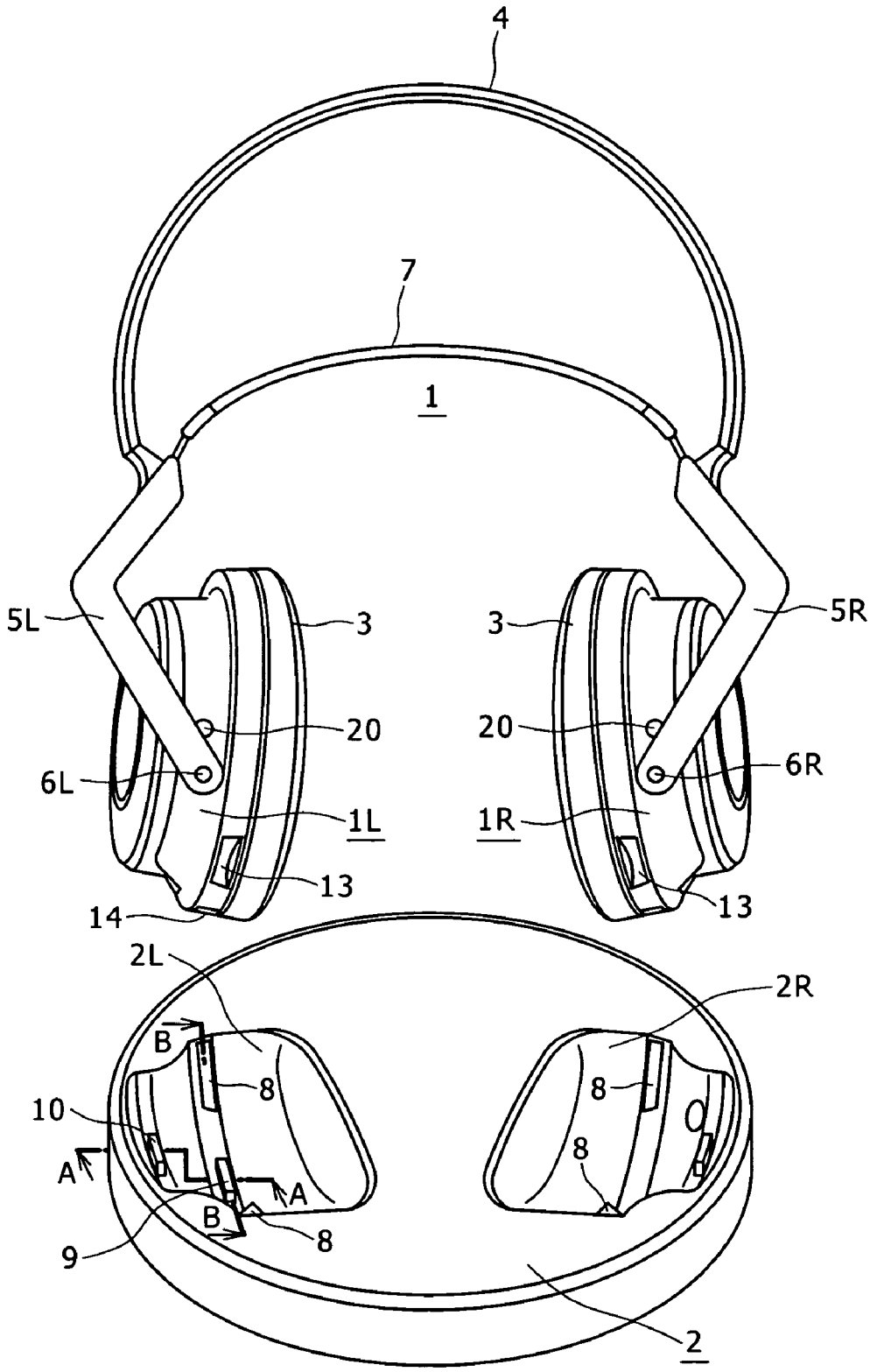
FIG. 1 is a perspective view of a headphones placement device according to an embodiment of the present invention, showing headphones lifted off a placement base.

As shown in FIG. 1, a headphones placement device according to an embodiment of the present invention includes wireless headphones 1 and a charger base 2 doubling as a placement base for charging a secondary cell incorporated in the wireless headphones 1.

The wireless headphones 1 have a pair of left and right housings 1L, 1R each in the form of a flat dish incorporating a speaker therein. The housings 1L, 1R are substantially circular in shape as viewed in side elevation, and have respective pads 3 for contact with the ears of the user. The housings 1L, 1R are connected to each other by a head band 4. The head band 4 has respective support arms 5L, 5R on opposite ends thereof. The housings 1L, 1R are angularly movable about respective pivots 6L, 6R on the distal ends of the support arms 5L, 5R to adjust the angular orientation of the pads 3 which face each other so that the pads 3 can neatly be placed over the respective ears of the user.

A presser band 7 for pressing the top of the head of the user is disposed below the head band 4. Specifically, the presser band 7 is coupled to the proximal ends of the respective support arms 5L, 5R by stretchable joint belts extending from the respective opposite ends of the presser band 7.

As shown in FIG. 1, the charger base 2 has a disk-shaped casing of a predetermined thickness. The charger base 2 has a pair of positioning cavities 2L, 2R defined in an upper surface thereof and extending substantially parallel to each other. The positioning cavities 2L, 2R receive therein respective portions of the housings 1L, 1R remote from the head band 4 to position the housings 1L, 1R on the charger base 2. The casing of the charger base 2 is injection-molded of a synthetic resin such as plastic or the like.

Two pairs of spaced guide ribs 8 for guiding the housings 1L, 1R toward the respective bottoms of the positioning cavities 2L, 2R are disposed respectively in the positioning cavities 2L, 2R. A projecting charging connector 9 which is movable vertically along the direction in which the housing 1L is inserted or removed is disposed centrally on the bottom of the positioning cavity 2L. The charging connector 9 includes an insulation plate made of plastic or the like and having a predetermined height and width, and six contacts $\mathbf{9}a_1$ through $\mathbf{9}a_6$ in the form of metal leaf springs disposed on a side surface of the insulation plate.

A pusher 10 in the form of a plate made of synthetic resin or the like and having a predetermined height is disposed in the positioning cavity 2L at a position spaced from the charging connector 9. The pusher 10 is movable vertically along the direction in which the housing 1L is inserted or removed.

The charging connector 9 and the presser 10 are constructed as a seesaw mechanism. Specifically, as shown in FIGS. 2A, 2B and FIG. 3A, 3B, the charging connector 9 has a lower end held against an end of a seesaw plate 11 which is pivoted at its center for up-and-down movement. The lower end of the charging connector 9 is normally biased to move downwardly by helical springs 12 acting between the bottom of the positioning cavity 2L and the charging connector 9. The pusher 10 has a lower end held against the other end of the seesaw plate 11.

Figure 2A:
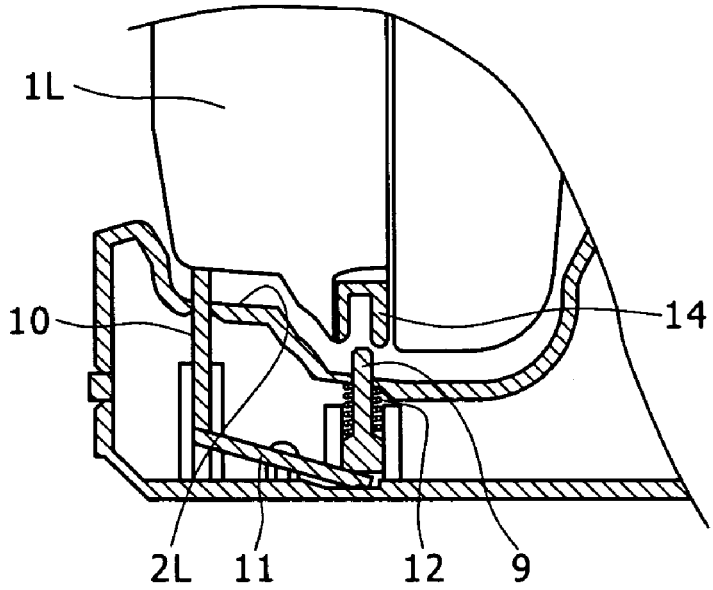
FIG. 2A is an enlarged fragmentary cross-sectional view taken along line A-A of FIG. 1, showing a charging connector in a lower position.
Figure 2B:
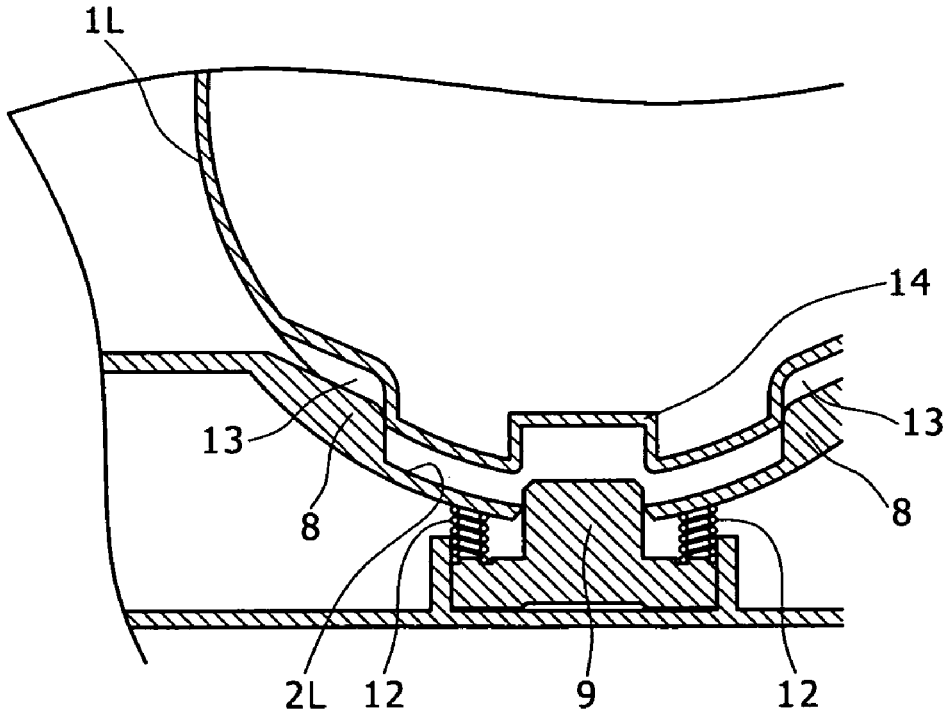
FIG. 2B is an enlarged fragmentary cross-sectional view taken along line B-B of FIG. 1, showing the charging connector in the lower position.
Figure 3A:
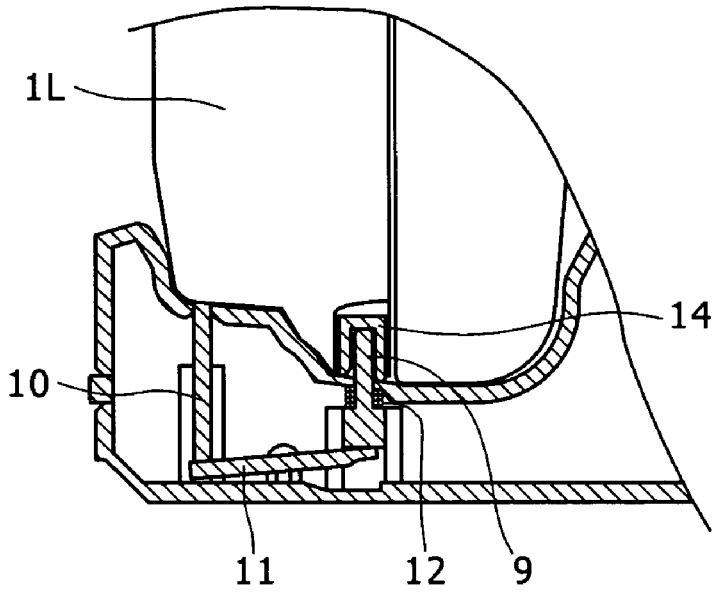
FIG. 3A is an enlarged fragmentary cross-sectional view taken along line A-A of FIG. 1, showing the charging connector in an upper position.
Figure 3B:
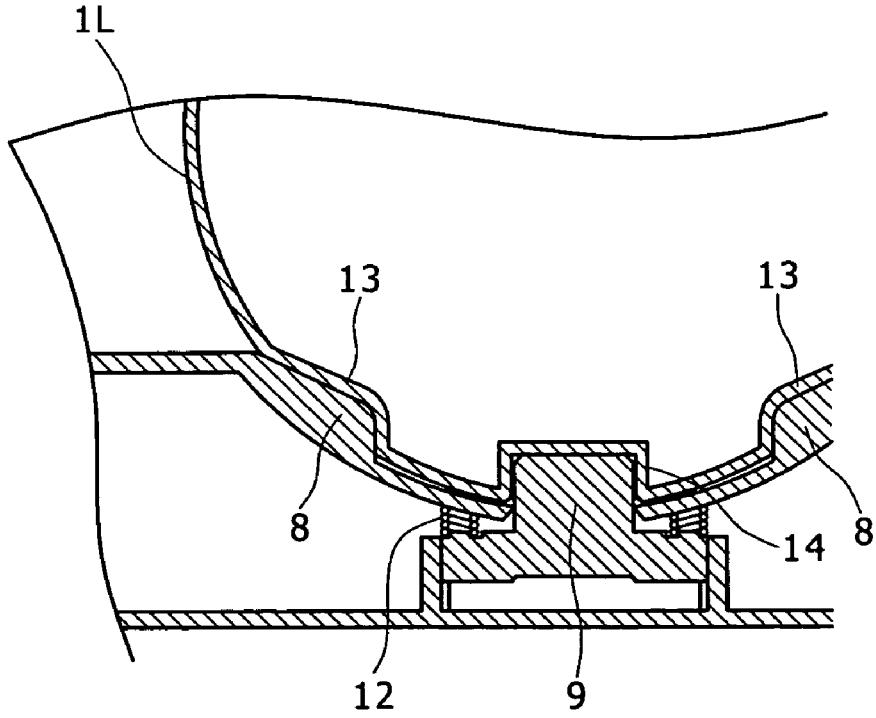
FIG. 3B is an enlarged fragmentary cross-sectional view taken along line B-B of FIG. 1, showing the charging connector in the upper position.
Figure 4:
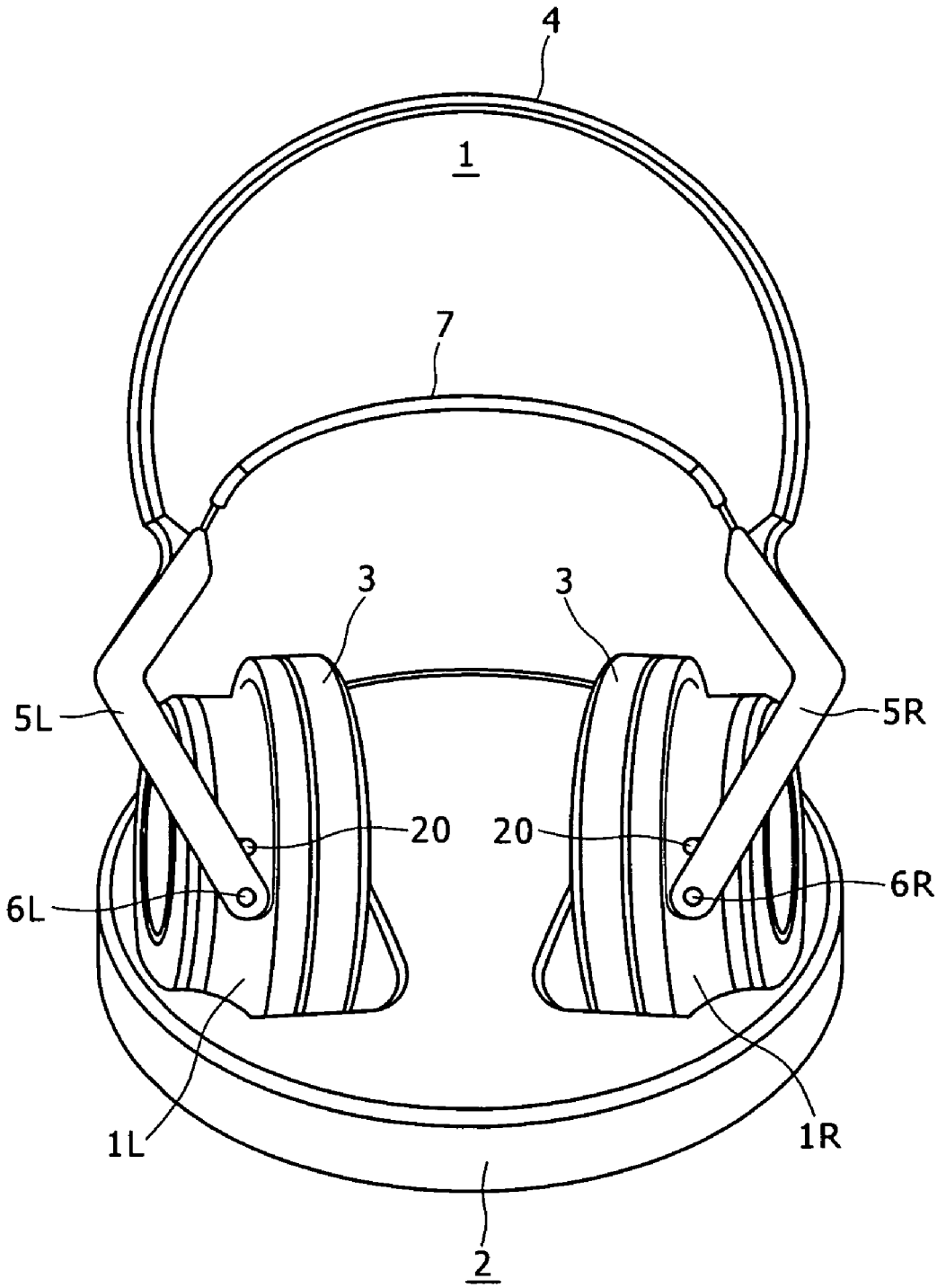
FIG. 4 is a perspective view of a headphones placement device according to the embodiment of the present invention, showing the headphones placed on the placement base.

Usually, the charging connector 9 is biased downwardly under the resiliency of the helical springs 12, as shown in FIGS. 2A, 2B. When the upper end of the pusher 10 is pushed downwardly, the charging connector 9 is moved upwardly to project from the bottom of the positioning cavity 2L against the bias of the helical springs 12, as shown in FIGS. 3A, 3B.

The housings 1L, 1R have respective pairs of guide grooves 13 defined in outer circumferential surfaces thereof for receiving the respective guide ribs 8 in the positioning cavities 2L, 2R of the charging base 2 to guide the housings 1L, 1R onto the bottoms of the positioning cavities 2L, 2R.

The housing 1L has a recessed charging connector 14 defined centrally in a lower portion thereof for receiving the projecting charging connector 9 of the charging base 2, as shown in FIGS. 1, 2A, 2B, 3A, 3B. The recessed charging connector 14 has six contacts $\mathbf{14}a_1$ through $\mathbf{14}a_6$ disposed on a side surface of a rectangular recess defined centrally in the lower portion of the housing 1L. When the recessed charging connector 14 receives the projecting charging connector 9, the contacts $\mathbf{14}a_1$ through $\mathbf{14}a_6$ are aligned with the respective contacts $\mathbf{9}a_1$ through $\mathbf{9}a_6$ on the projecting charging connector 9.

When the housings 1L, 1R are guided by the guide ribs 8 and the guide grooves 13 and placed into the respective positioning cavities 2L, 2R in the charger base 2, the housing 1L pushes the pusher 10 downwardly, displacing the projecting charging connector 9 upwardly into the recessed charging connector 14 in the housing 1L thereby to electrically connect the contacts $\mathbf{9}a_1$ through $\mathbf{9}a_6$ to the contacts $\mathbf{14}a_1$ through $\mathbf{14}a_6$.

As described above, the housings 1L, 1R are angularly movable about the respective pivots 6L, 6R. Since the housings 1L, 1R are swingable with respect to the support arms 5L, 5R, respectively, of the head band 4, it is relatively difficult to position the housings 1L, 1R respectively in the positioning cavities 2L, 2R.

According to the present embodiment, the headphones 1 have a stabilizer for limiting the angular movement of the housings 1L, 1R when the housings 1L, 1R are placed in the respective positioning cavities 2L, 2R, as described below.

Figure 5:
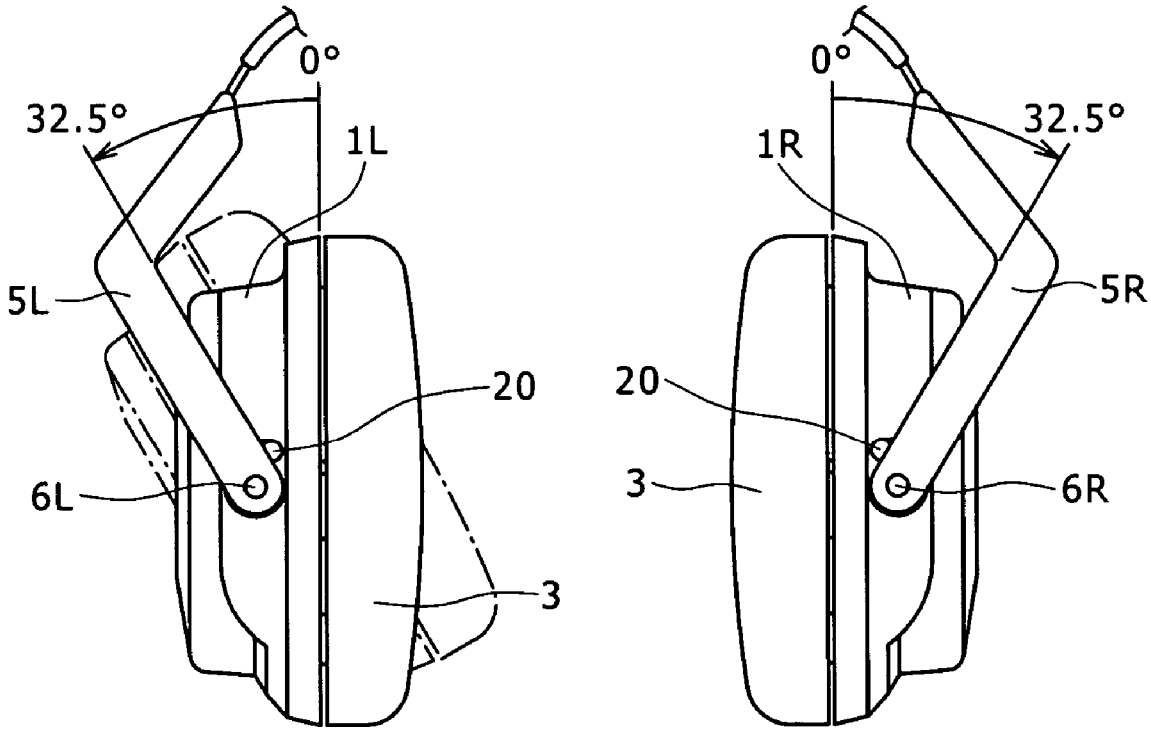
FIG. 5 is a front elevational view of the headphones.
Figure 6:
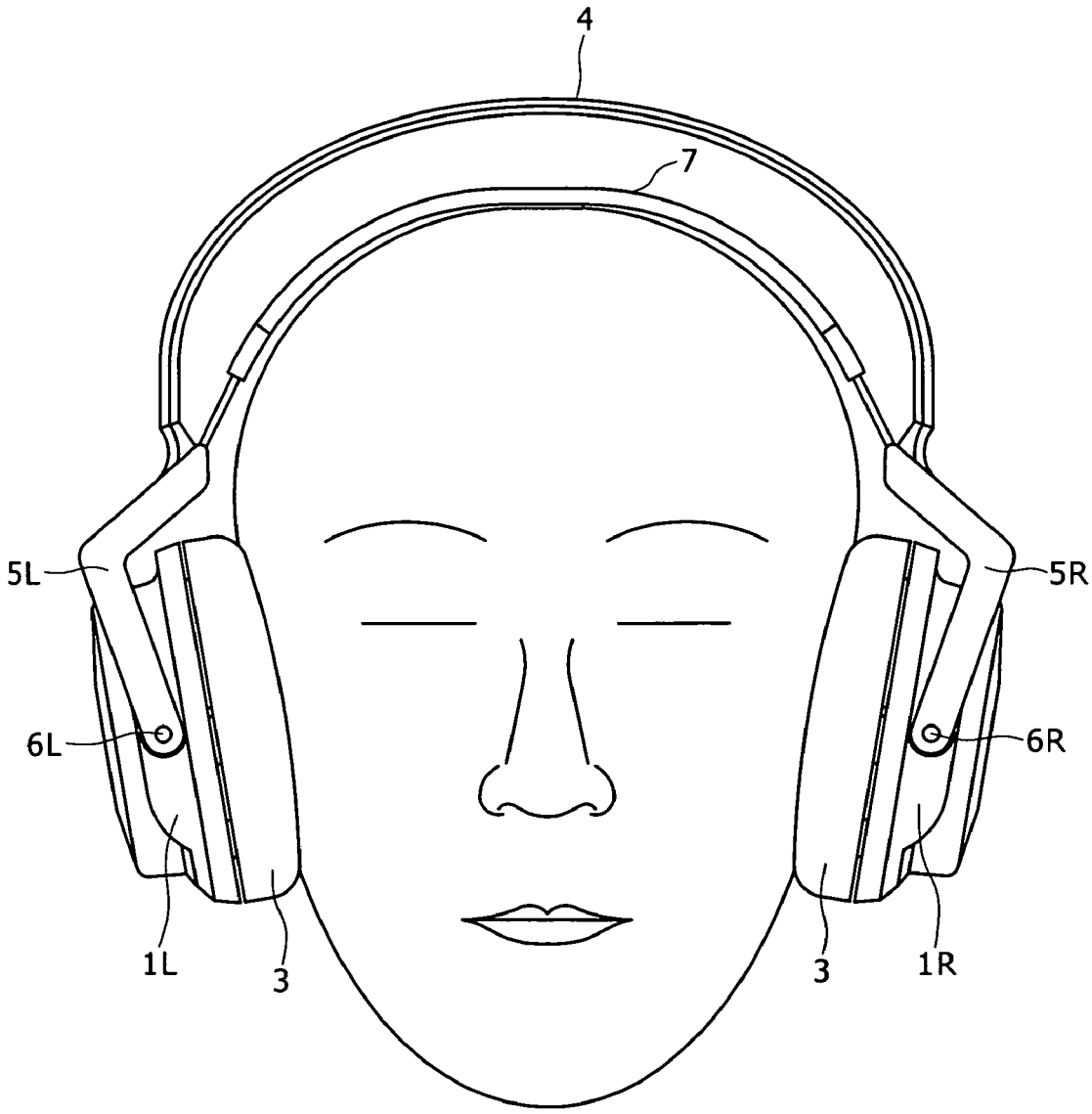
FIG. 6 is a front elevational view showing the manner in which the headphones are worn by a user.

If the housings 1L, 1R are placed in the respective positioning cavities 2L, 2R at an angle of 0° with respect to each other, as shown in FIG. 5, then the housings 1L, 1R are turned generally through an angle ranging from 12.5° to 32.5° when the housings 1L, 1R are placed over the respective ears of the user, as shown in FIG. 6.

Figure 7:
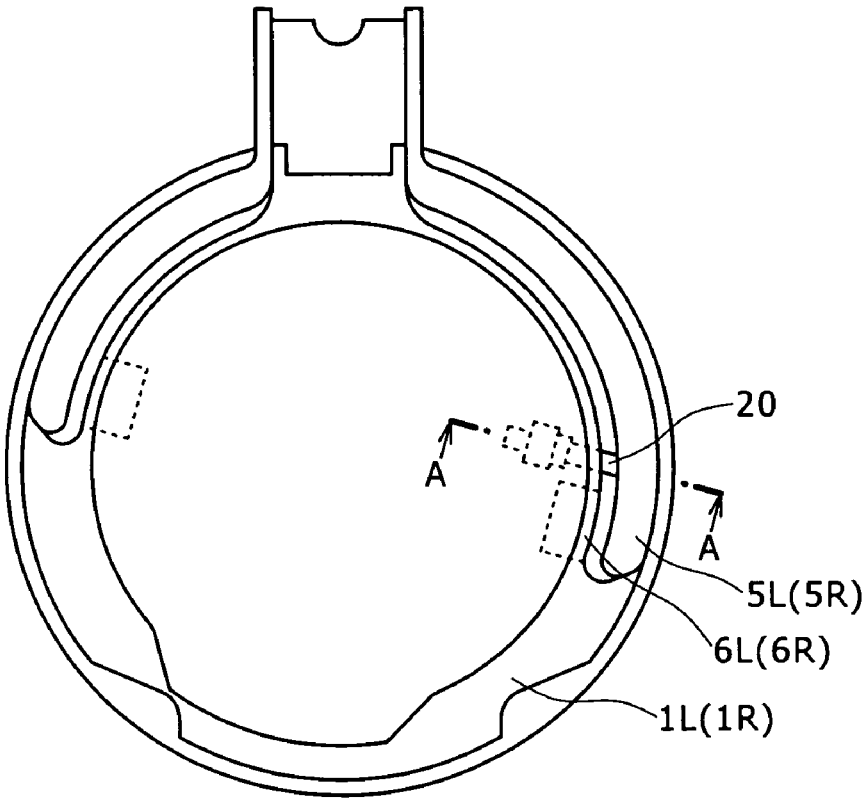
FIG. 7 is a side elevational view of one of the headphones.
Figure 8:
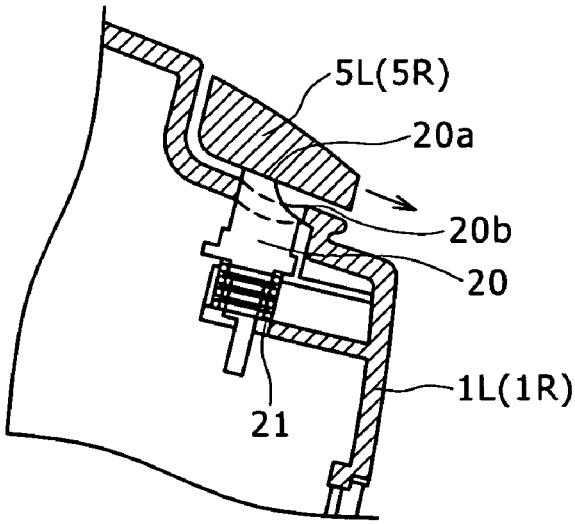
FIG. 8 is an enlarged fragmentary cross-sectional view taken along line A-A of FIG. 7.

As shown in FIGS. 1, 7, 8, the housings 1L, 1R have respective pressers 20 disposed near and above the pivots 6L, 6R by which the support arms 5L, 5R are supported. The pressers 20 are positioned in the respective housings 1L, 1R and have respective heads 20*a* projecting substantially perpendicularly from outer circumferential walls of the housings 1L, 1R into abutting engagement with the support arms 5L, 5R.

As shown in FIG. 8, each of the pressers 20 is normally biased by a compression helical spring 21 to project substantially perpendicularly from the outer circumferential wall of one of the housings 1L, 1R.

The head 20*a* of the presser 20 has a step 20*b* slanted to one side of the presser 20. When the step 20*b* is held against the support arm 5R (5L), as shown in FIG. 9A, the housing 1R (1L) is placed in the corresponding positioning cavity 2R (2L).

When the housings 1L, 1R lie substantially parallel to each other at an angle of 0° with respect to each other, as shown in FIG. 5, the steps 20*b* of the pressers 20 are held against the respective support arms 5L, 5R.

Figures 9A, 9B, 9C:
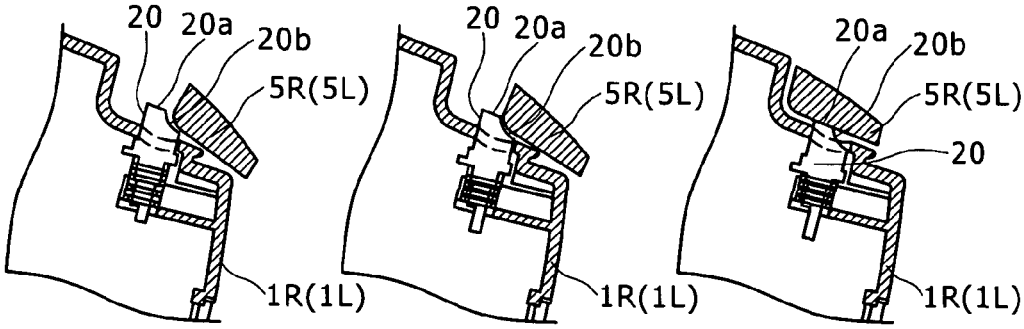
FIGS. 9A, 9B and 9C are enlarged fragmentary cross-sectional views taken along line A-A of FIG. 7, showing the manner in which the headphones operate.

The housings 1L, 1R incorporate stoppers (not shown) for preventing the housings 1L, 1R from being turned through angles smaller than 0° when the support arms 5L, 5R engage the respective steps 20*b* as shown in FIG. 9A.

When the housings 1L, 1R are turned in the directions indicated by the arrows in FIG. 5 from the position shown in FIG. 9A, the support arm 5R (5L) moves relatively to the presser 20 as shown in FIGS. 9B, 9C. Specifically, the support arm 5R (5L) moves relatively to the presser 20 as shown in FIG. 9B when the housing 1R (1L) is turned 5.5° in the directions indicated by the arrows in FIG. 5 from the position shown in FIG. 9A. At this time, the support arm 5R (5L) is displaced out of contact with the step 20*b* and is about to ride onto the tip of the head 20*a*. The support arm 5R (5L) moves relatively to the presser 20 as shown in FIG. 9C when the housing 1R (1L) is turned 32.5° in the directions indicated by the arrows in FIG. 5 from the position shown in FIG. 9A. At this time, the support arm 5R (SL) is placed on and held against the tip of the head 20*a*.

Figure 10:
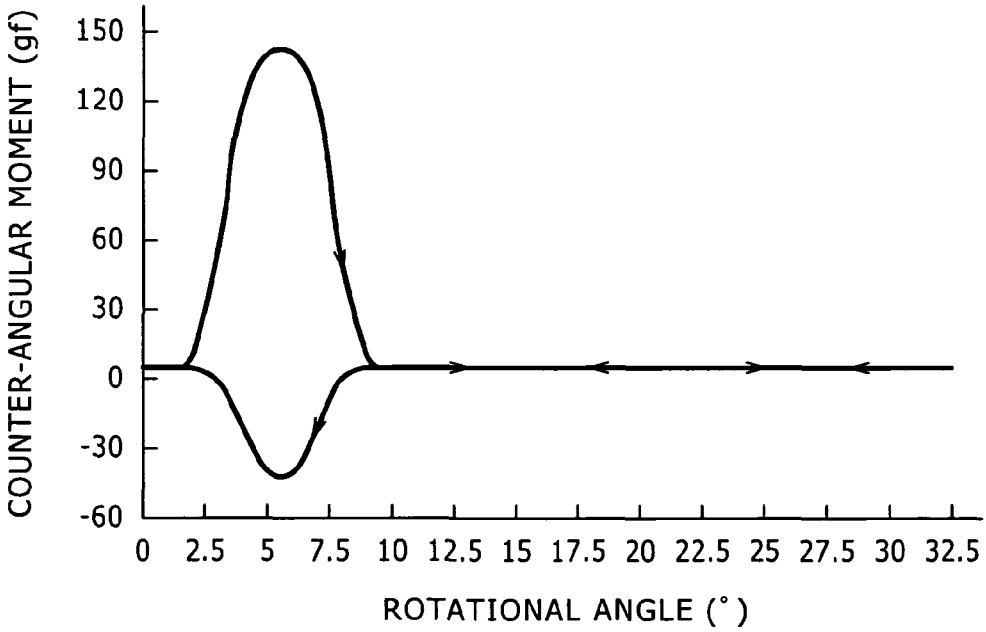
FIG. 10 is a diagram showing the relationship between the rotational angle of the headphone and the counter-angular moment thereof.

The rotational angle of the housings 1L, 1R and the counter-angular moment thereof are related to each other as shown in FIG. 10. Specifically, when the housings 1L, 1R that are placed in the respective positioning cavities 2L, 2R are turned in the directions indicated by the arrows in FIG. 5, the support arms 5L, 5R are displaced out of contact with the steps 20*b* and are about to ride onto the tips of the heads 20*a*. When the support arms 5L, 5R are turned 5.5°, the counter-angular moment of the housings 1L, 1R is maximum. When the support arms 5L, 5R are placed on and held against tips of the heads 20*a* and subsequently, the counter-angular moment of the housings 1L, 1R becomes substantially nil, as if there were no pressers 20.

When the housings 1L, 1R are turned in directions opposite from the directions indicated by the arrows in FIG. 5 from the 32.5° position, the counter-angular moment of the housings 1L, 1R is substantially nil. When the support arms 5L, 5R move from the tips of the heads 20*a* onto the steps 20*b*, since the support arms 5L, 5R are pressed by the steps 20*b*, the counter-angular moment of the housings 1L, 1R becomes negative. Thereafter, the counter-angular moment of the housings 1L, 1R becomes nil, limiting angular movement of the housings 1L, 1R.

Figures 11A, 11B:
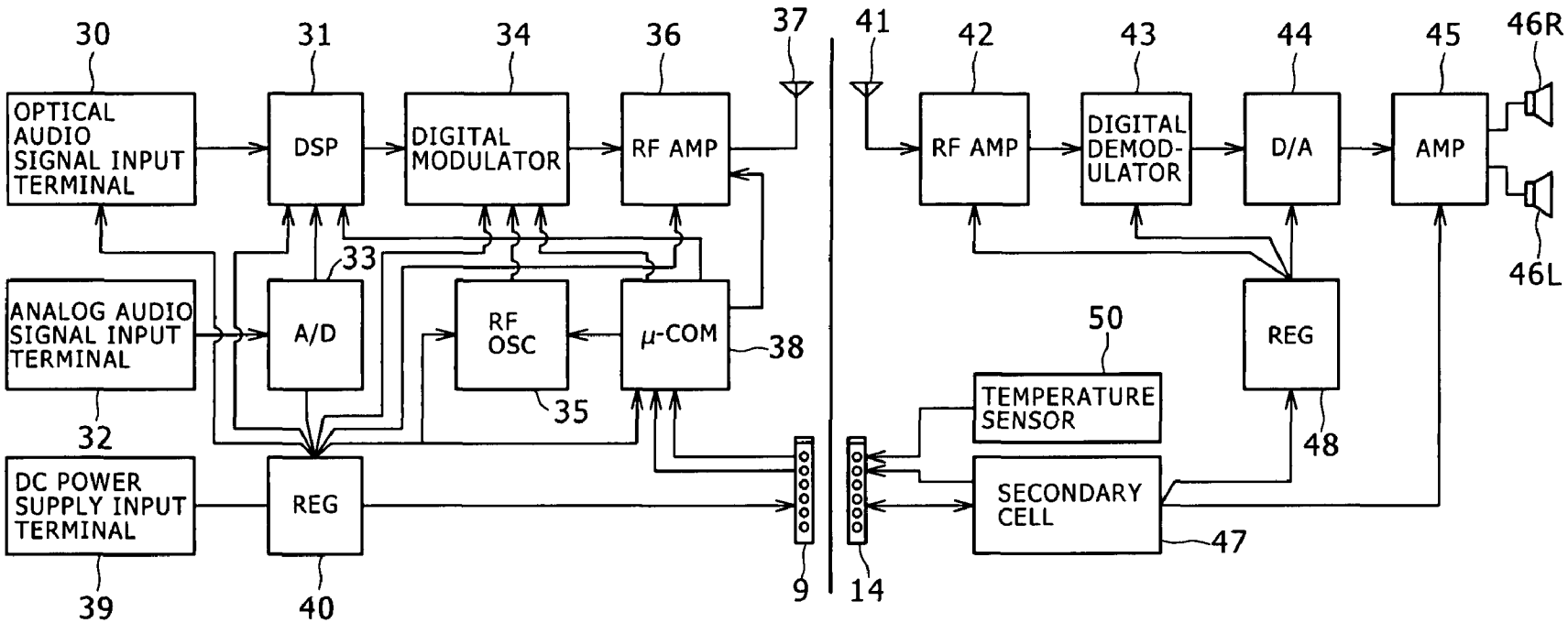
FIGS. 11A and 11B are block diagrams of a transmitter and a receiver of the headphones as wireless headphones.

The charger base 2 incorporate therein a transmitter for transmitting audio signals as shown in FIG. 11A, and the headphones 1 incorporate therein a receiver for receiving audio signals as shown in FIG. 11B. The headphones 1 are constructed as wireless headphones.

Figure 12B:
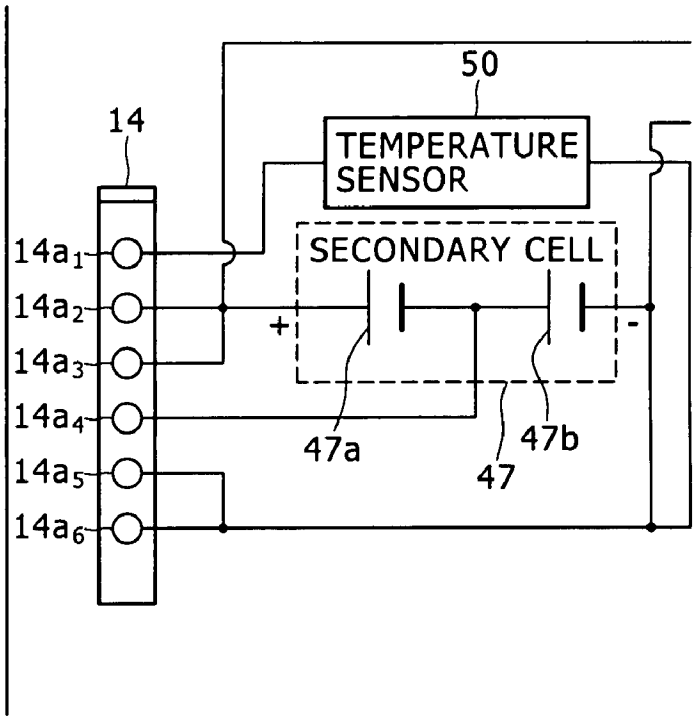
FIGS. 12A and 12B are block diagrams of a charging circuit of a charger according to an embodiment of the present invention.
Figure 12A:
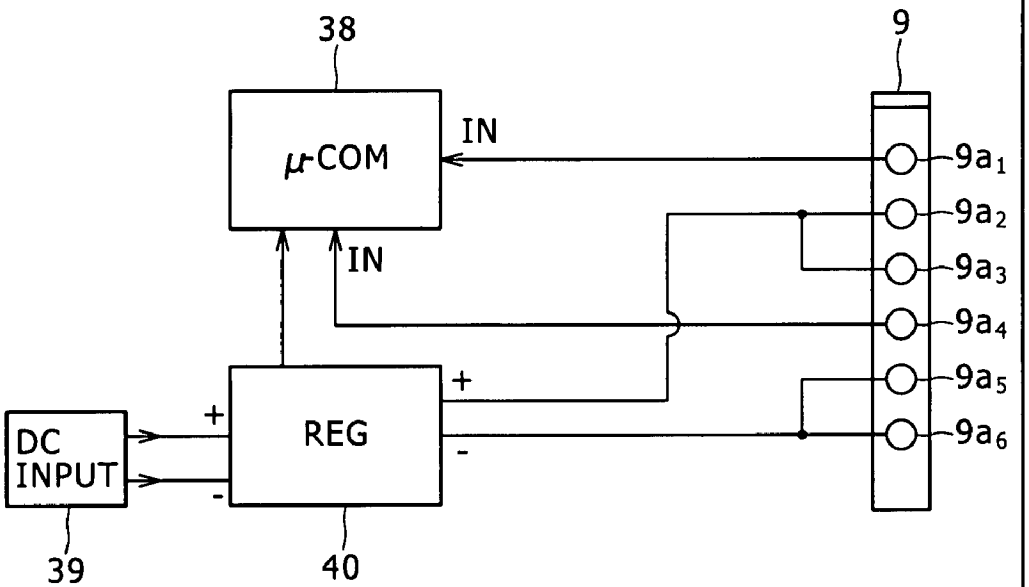

The charger base 2 incorporates a charging circuit therein as shown in FIG. 12A, and the headphones 1 incorporate a secondary cell 47 therein shown in FIG. 12B. The secondary cell 47 can be charged by the charging circuit.

As shown in FIG. 11A, the transmitter has an optical audio signal input terminal 30 for being supplied with an optical audio signal from a DVD or the like. The optical audio signal input terminal 30 supplies a digital audio signal to a digital signal processor (DSP) 31 which processes the audio signal.

The transmitter also has an analog audio signal input terminal 32 for being supplied with an analog audio signal. The analog audio signal input terminal 32 supplies an analog audio signal to an A/D converter 33, which converts the analog audio signal into a digital audio signal and supplies the digital audio signal to the digital signal processor 31.

The digital signal processor 31 supplies an output signal to a digital modulator 34. The digital modulator 34 is also supplied with an RF signal from an RF oscillator 35. The digital modulator 34 modulates the RF signal with the digital signal from the digital signal processor 31, and supplies a digital modulated signal through an RF amplifier 36 to an antenna 37, which radiates the digital modulated signal as a radio wave.

The transmitter has a microcomputer 38 for controlling the transmitter. Specifically, the microcomputer 38 controls the digital signal processor 31, the digital modulator 34, the RF oscillator 35, the RF amplifier 36, etc.

The transmitter also has a DC power supply input terminal 39 for being supplied with DC electric power. The DC power supply input terminal 39 supplies DC electric power to regulator 40, which supplies regulated DC electric power to optical audio signal input terminal 30, the digital signal processor 31, the A/D converter 33, the digital modulator 34, the RF oscillator 35, the RF amplifier 36, the microcomputer 38, etc.

The receiver shown in FIG. 11B is housed in the housing 1R of the headphones 1. The receiver has an antenna 41 for receiving a digital modulated signal transmitted from the transmitter shown in FIG. 11A. The antenna 41 supplies the digital modulated signal through an RF amplifier 42 to a digital demodulator 43.

The digital demodulator 43 demodulates the digital modulated signal into a digital audio signal, and supplies the digital audio signal to a D/A converter 44. The D/A converter 44 converts the digital signal into an analog audio signal, and supplies the analog audio signal through an output amplifier 45 to a speaker 46L housed in the housing 1L and a speaker 46R housed in the housing 1R.

The receiver also has a secondary cell 47 which supplies a DC voltage to a regulator 48 and also to the output amplifier 45. The regulator 47 supplies regulated DC electric power to the RF amplifier 42, the digital demodulator 43, the D/A converter 44, etc.

The secondary cell 47, which may include two lithium ion cells, for example, is housed in the housing 1L.

The charging circuit incorporated in the charger base 2 as shown in FIG. 12A charges the secondary cell 47 when the housings 1L, 1R are placed respectively in the positioning cavities 2L, 2R.

As shown in FIG. 12A, the charging circuit is made up of the DC power supply input terminal 39, the regulator 40, and the microcomputer 38. The regulator 40 has a positive output terminal connected to the second and third contacts $9a_2$, $9a_3$ of the projecting charging connector 9 and a negative output terminal connected to the fifth and sixth contacts $9a_5$, $9a_6$.

The microcomputer 38 controls a protection circuit, a quick charging mode, etc. of the charging circuit. The microcomputer 38 is supplied with a detected temperature signal from a temperature sensor 50, to be described later, through the first contact $9a_1$, and is also supplied with a voltage from the midpoint between two lithium ion cells 47*a*, 47*b* through the fourth contact $9a_4$.

As shown in FIG. 12B, the secondary cell 47, which is made up of the two series-connected lithium ion cells 47*a*, 47*b*, has a positive terminal connected to the second and third contacts 14$a_2$, 14$a_3$ of the recessed charging connector 14, and a negative terminal connected to the fifth and sixth contacts 14$a_5$, 14$a_6$.

The temperature of the secondary cell 47 is detected by the temperature sensor 50, which supplies a detected temperature signal to the first contact 14$a_1$.

In order to detect the voltages across the respective lithium ion cells 47$a$, 47$b$, the voltage of the midpoint between the lithium ion cells 47$a$, 47$b$ is applied to the fourth contact 14$a_4$.

When the contacts 9$a_1$ through 9$a_6$ of the projecting charging connector 9 and the contacts 14$a_1$ through 14$a_6$ of the recessed charging connector 14 are connected to each other, the secondary cell 47 housed in the headphones 1 can be charged by the charging circuit housed in the charger base 2.

The six contacts of the projecting charging connector 9 and the six contacts of the recessed charging connector 14 allow the microcomputer 38 to recognize the voltages across the lithium ion cells 47$a$, 47$b$ and the temperature of the secondary cell 47, to charge the secondary cell 47 in a quick charging mode as well in an ordinary charging mode, and to operate the protection circuit.

According to the present embodiment, as described above, when the housings 1L, 1R are guided by the guide ribs 8 and the guide grooves 13 and placed into the respective positioning cavities 2L, 2R in the charger base 2, the housing 1L pushes the pusher 10 downwardly, displacing the projecting charging connector 9 upwardly into the recessed charging connector 14 in the housing 1L thereby to electrically connect the contacts 9$a_1$ through 9$a_6$ to the contacts 14$a_1$ through 14$a_6$. Consequently, the housings 1L, 1R of the wireless headphones 1 incorporating the secondary cell 47 can easily be placed in given positions on the charger base 2, and the contacts 9$a_1$ through 9$a_6$ of the projecting charging connector 9 and the contacts 14$a_1$ through 14$a_6$ of the recessed charging connector 14 can reliably and stably be electrically connected to each other.

Furthermore, the heads 20$a$ of the pressers 20 have the respective step 20$b$. When the steps 20$b$ are held against the respective support arms 5L, 5R, the housings 1L, 1R are placed respectively in the positioning cavities 2L, 2R in the charger base 2. At this time, since the housings 1L, 1R are limited against angular movement, they can easily be put into the respective positioning cavities 2L, 2R.

Figure 13:
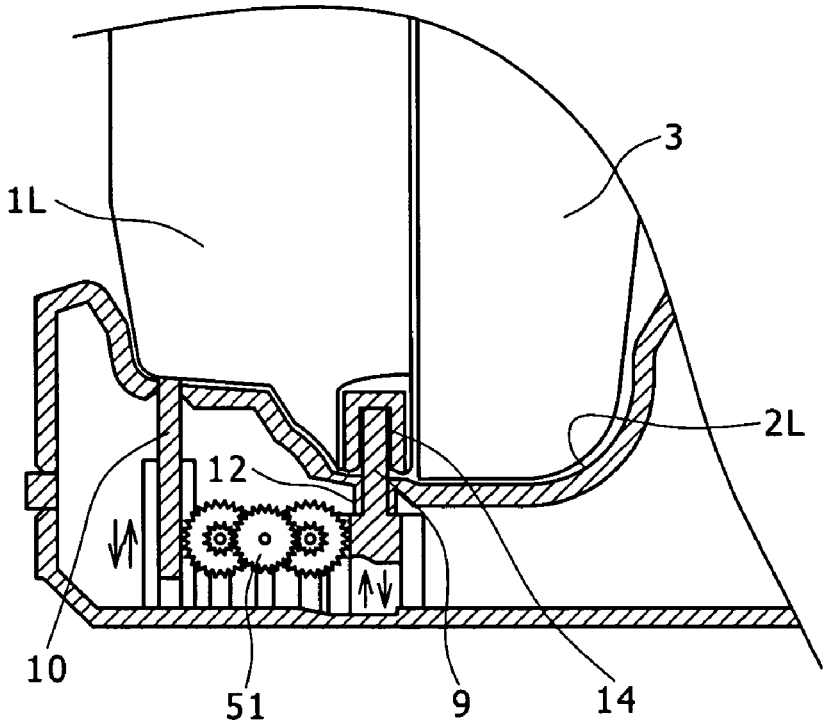
FIG. 13 is an enlarged fragmentary cross-sectional view of a headphones placement device according to another embodiment of the present invention.

In the above embodiment, the presser 10 and the charging connector 9 are constructed as a seesaw mechanism. However, as shown in FIG. 13, a gear mechanism 51 may be disposed between and operatively connected to the presser 10 and the charging connector 9 such that when the presser 10 is depressed, the projecting charging connector 9 is lifted into the recessed charging connector 14. The arrangement shown in FIG. 13 operates in the same manner and offers the same advantages as the above embodiment.

Figure 14:
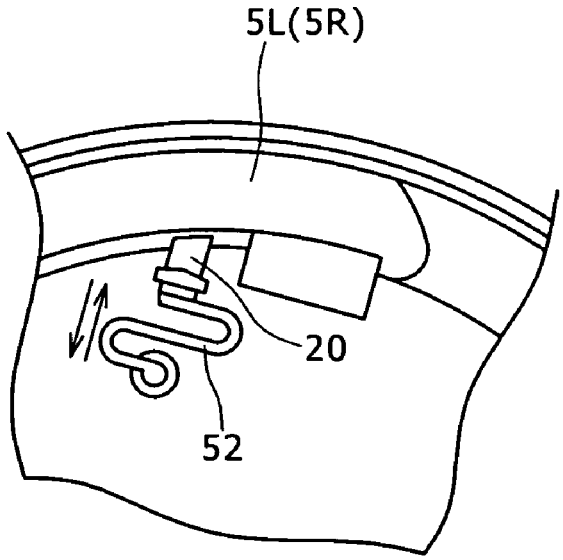
FIG. 14 is an enlarged fragmentary view showing headphones according to still another embodiment of the present invention.
Figure 15:
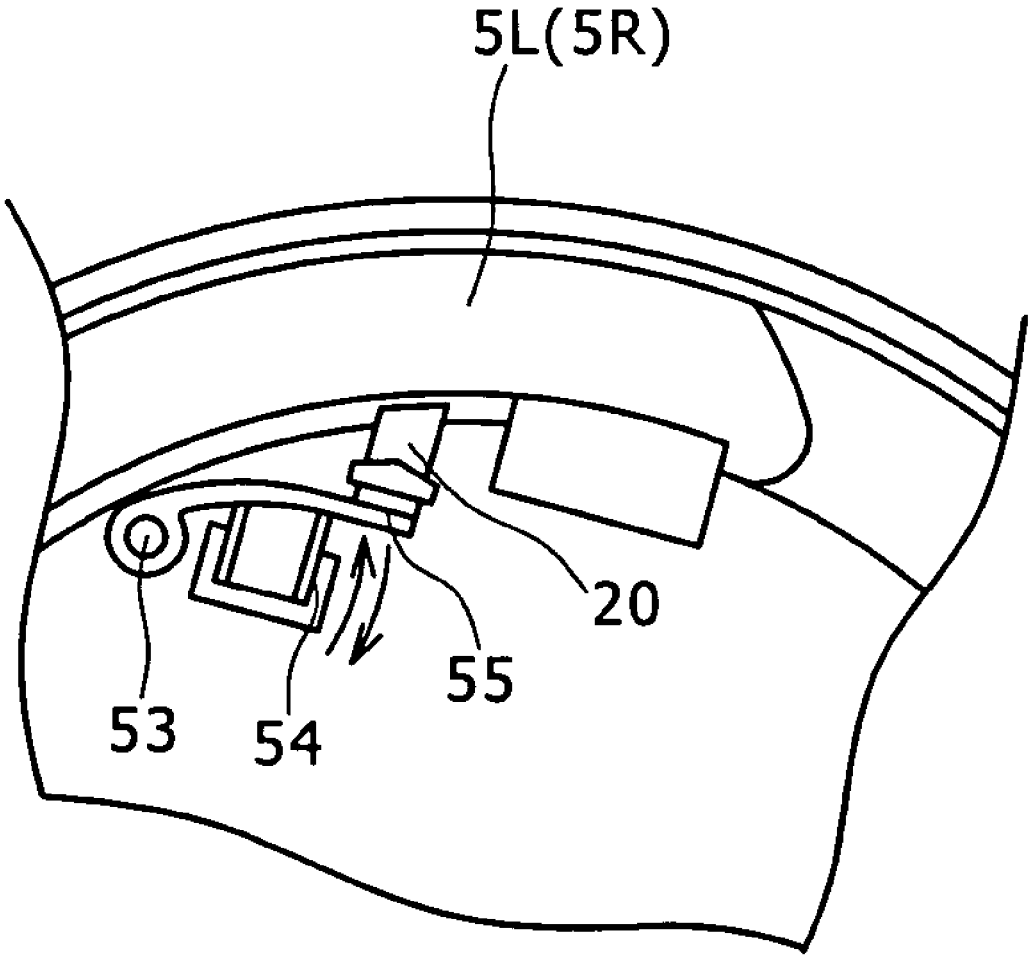
FIG. 15 is an enlarged fragmentary view showing headphones according to yet another embodiment of the present invention.

In the above embodiment, the pressers 20 as a stabilizer are normally urged by the compression helical springs 21 to project substantially perpendicularly from the outer circumferential walls of the housings 1L, 1R. However, as shown in FIG. 14, each of the pressers 20 may be normally urged by a spring member 52 made of synthetic resin such as plastic or the like to project substantially perpendicularly from the outer circumferential wall of one of the housings 1L, 1R. Alternatively, as shown in FIG. 15, each of the pressers 20 may be held against an end of an arm 55 that is angularly movably supported by a pivot 53 and normally urged by a helical spring 54 to turn about the pivot 53, so that the presser 20 may be caused by the spring-biased arm 55 to project substantially perpendicularly from the outer circumferential wall of one of the housings 1L, 1R. The arrangements shown in FIGS. 14 and 15 operate in the same manner and offer the same advantages as the above embodiment.

Although certain preferred embodiments of the present invention have been shown and described in detail, it should be understood that various changes and modifications may be made therein without departing from the scope of the appended claims.

What is claimed is:

1. A pair of headphones comprising:

a head band having a pair of support arms; and a pair of housings angularly movably mounted on said support arms, respectively, by pivots in confronting relation to each other;

each of said housings having a presser disposed therein near the pivot and projecting substantially perpendicularly to an outer surface of the housing, said presser having a head held against one of the support arms under resiliency, said head having a step engageable with said support arm for limiting angular movement of the housing with respect to said support arm.

2. The pair of headphones according to claim 1, wherein said presser is normally biased by a helical spring to cause said head to be held against said one of the support arms.

* * * * *